US005152581A

United States Patent [19]

Norsworthy

[11] Patent Number: 5,152,581

[45] Date of Patent: Oct. 6, 1992

[54] MUSIC SEAT

[75] Inventor: John A. Norsworthy, Gloucester, Canada

[73] Assignee: Unique-Quality Products, Inc., Calgary, Canada

[21] Appl. No.: 618,264

[22] Filed: Nov. 21, 1990

[30] Foreign Application Priority Data

Oct. 24, 1990 [CA] Canada ..... 2028406

[51] Int. Cl.[5] ..... A47C 7/50

[52] U.S. Cl. ..... 297/429; 297/437; 297/433; 248/188.9

[58] Field of Search ..... 297/429, 430, 431, 432, 297/423, 186, 67, 345; 248/188.7, 188.9

[56] References Cited

U.S. PATENT DOCUMENTS

| | | | |
|---|---|---|---|
| 482,520 | 9/1892 | Field | 297/423 |
| 659,933 | 10/1900 | Marks | 297/437 |
| 740.966 | 10/1903 | Wylie | 297/430 |
| 1,404,449 | 1/1922 | Lahm | 297/436 |
| 2,278,080 | 3/1942 | Koenigkramer et al. | 297/423 |
| 2,341,751 | 2/1944 | Willoughby | 248/188.9 |
| 2,375,696 | 5/1945 | Shick | 297/429 |
| 2,850,077 | 9/1958 | Dowson | 297/437 |
| 3,208,698 | 9/1965 | Somhammer et al. | 248/188.9 |
| 3,625,563 | 12/1971 | Dickinson | 297/437 |
| 4,063,321 | 12/1977 | Nichols | 297/429 |
| 4,148,524 | 4/1979 | Guyton | 297/423 |
| 4,650,249 | 3/1987 | Serber | 297/423 |
| 4,765,684 | 8/1988 | Kvalheim et al. | 297/429 |
| 4,767,160 | 8/1988 | Mengshoel et al. | 297/423 |

FOREIGN PATENT DOCUMENTS

| | | | |
|---|---|---|---|
| 2837558 | 3/1980 | Fed. Rep. of Germany | 297/437 |
| 2176396 | 12/1986 | United Kingdom | 297/423 |

*Primary Examiner*—Kenneth J. Dorner
*Assistant Examiner*—Cassandra L. Hope
*Attorney, Agent, or Firm*—Mason, Fenwick & Lawrence

[57] ABSTRACT

There is provided a new and useful musician's chair comprising a seat; a backrest extending upwardly from one side of the seat; a support for the seat, the support comprising an upright central part to the top of which the seat is attached and to the bottom of which a stabilizing base section is attached; and a footrest selectively moveable between a folded position adjacent the upright central part of the support and an extended position outwardly of the upright central part, and wherein the footrest when in the extended position is selectively moveable over a range of height adjustments.

18 Claims, 4 Drawing Sheets

MUSIC SEAT

FIELD OF THE INVENTION

This invention relates to chairs for musicians.

BACKGROUND OF THE INVENTION

There has long been a need for a comfortable chair for use by musicians in playing their instruments. This is particularly the case for stringed instruments such as banjos and guitars.

As is well known, student musicians frequently need to be rid of all distractions and to be otherwise encouraged to regularly practice with their instruments. One such distraction is an uncomfortable chair or stool which will not only lead to fidgeting and lack of attention during practice but will contribute to a dislike of practice sessions.

Comfortable chairs or stools have also not been made available to performers. Performers, particularly guitar players, will frequently utilize a basic stool from which to give a large part of their performance. Clearly a lack of comfort will be reflected in the performance.

For these and other reasons it is highly desirable that a comfortable chair or stool be made available for musicians.

It is against this background that the present invention arises. The present invention provides a much more versatile and more comfortable chair than is currently available.

PRIOR ART

Applicant is unaware of any specific prior art which is relevant to the present invention. Clearly various chairs and stools have been available over the years for use by musicians.

BRIEF SUMMARY OF THE INVENTION

The invention provides a musician's chair comprising a seat; a backrest extending upwardly from one side of the seat; a support for the seat, the support comprising an upright central part to the top of which the seat is attached and to the bottom of which a stabilizing base section is attached; and a footrest selectively moveable between a folded position adjacent the upright central part of the support and an extended position outwardly of the upright central part, and wherein the footrest when in the extended position is selectively moveable over a range of height adjustments.

BRIEF DESCRIPTION OF THE DRAWINGS

In drawings which illustrate embodiments of the invention.

Figure 1:
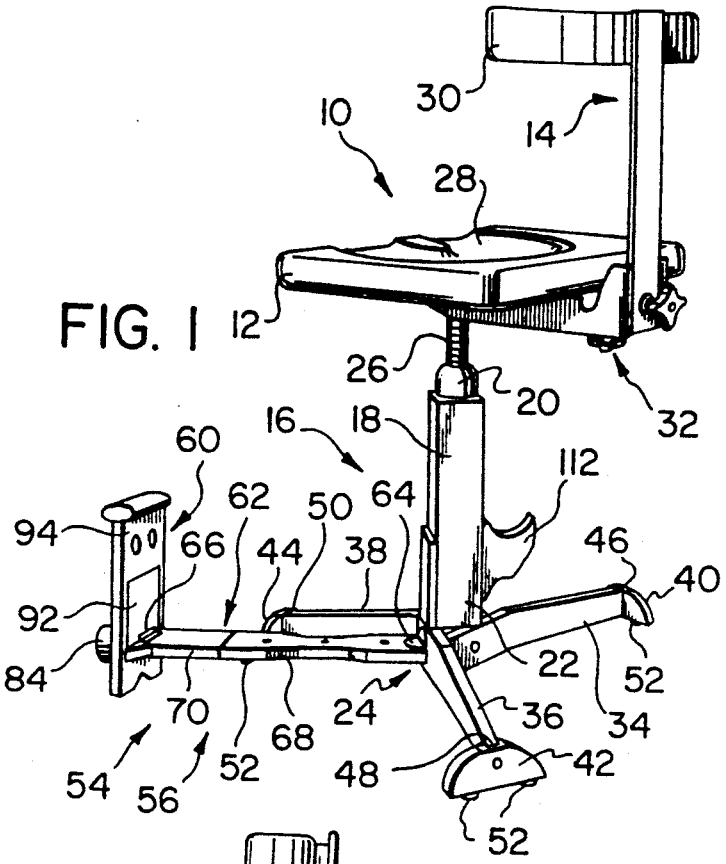
FIG. 1 is a perspective view of a chair according to the invention with footrest extended.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

The musician's chair 10 comprises a seat 12, a backrest 14 and a support 16.

The support 16 comprises an upright central part 18 having an upper end 20 and a lower end 22, and a stabilizing base section 24.

The seat 12 is attached to the upper end 20 of upright central section 18, preferably by means of vertical adjusting means such as threaded stem 26. The seat 12 is preferably provided with a contoured top surface 28.

The backrest 14 preferably comprises a small surface area as, for example, the banana shaped member 30. This permits good back support while at the same time providing very substantial freedom of movement to play the instrument.

Backrest 14 is preferably joined to seat 12 by a mechanism 32 which allows various vertical and tilting adjustments. Such a mechanism is of a type described, for example, in Canadian Patent 805,953 issued Feb. 11, 1969 to Doerner Products Co. Limited. The specific mechanism type is not critical to the invention.

The base section 24 comprises at least three equally spaced and outwardly extending legs 34, 36 and 38. As indicated, the legs 34, 36 and 38 are secured to the lower end 22 of upright central section 18. Cross members 40, 42 and 44 are secured toward or at the outer ends 46, 48 and 50 of legs 34, 36 and 38 respectively. Each said cross member carries a pair of feet 52 located on opposite sides of and spaced from respective ones of legs 34, 36 and 38.

This specific arrangement of supporting legs and feet, with six contact points with a supporting surface such as a floor, provides a high degree of stability and generally avoids any rocking motion due to uneven floors.

Figure 2:
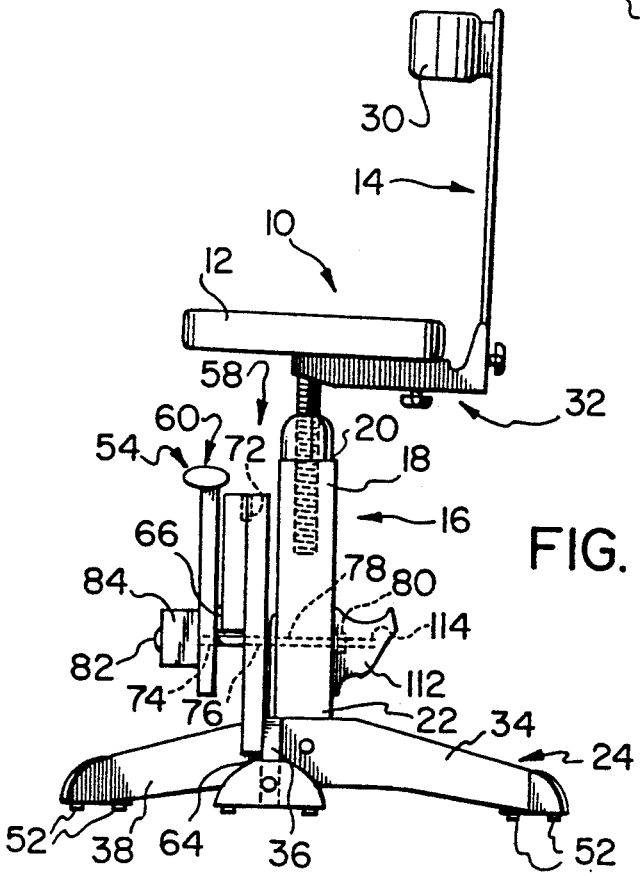
FIG. 2 is a side elevation of a chair according to the invention with folded.
Figure 3:
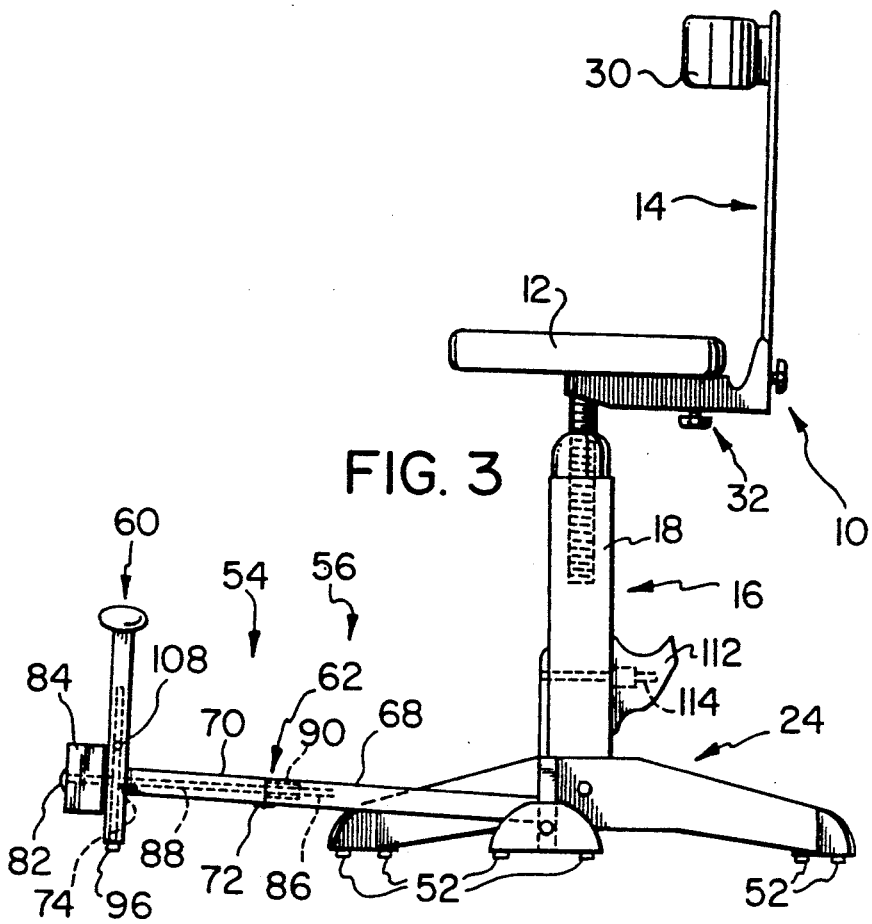
FIG. 3 is a side elevation of a chair according to the invention with footrest extended.

Chair 10 includes a footrest 54 which is selectively moveable between the extended position 56 illustrated in FIGS. 1 and 3 and the folded position 58 illustrated in FIG. 2.

Figure 1A:
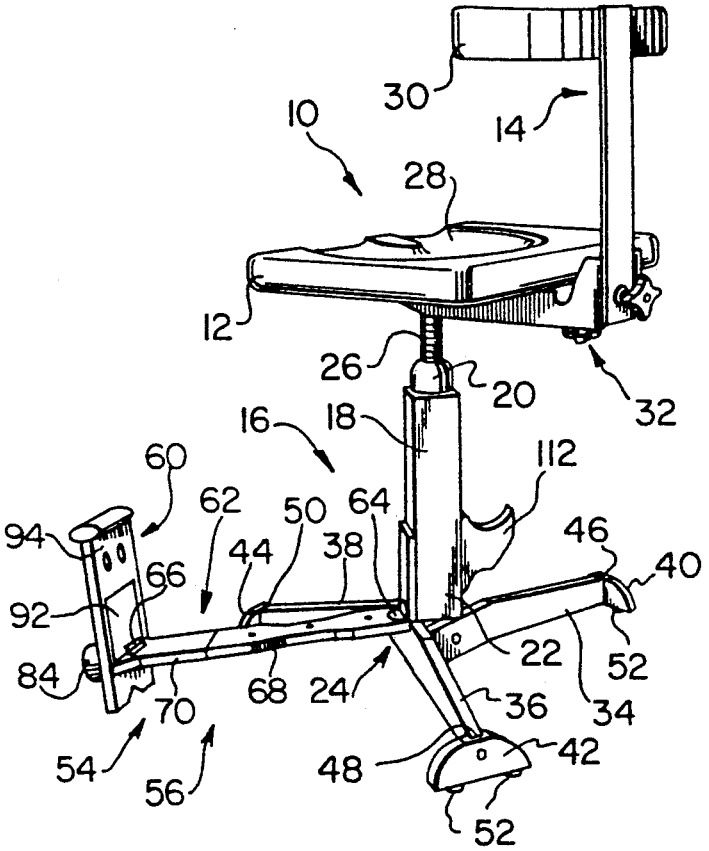
FIG. 1A is an alternative embodiment, showing the footrest extension attached at a slightly different point than the embodiment of FIG. 1.

The footrest comprises a foot support section 60 and an extension section 62. The extension section 62 may be hingedly connected by hinge 64 at a suitable point, such as either to (a) leg 36 of base section 24 shown in FIG. 1), or to (b) the upright central section 18 (shown in FIG. 1A). The extension section is also hingedly connected to foot support section 60 by hinge 66. Extension section 62 is itself preferably in two parts 68 and 70 connected to each other by hinge 72.

Various means may be utilized for securing footrest 54 in folded position 58. In the preferred case a bore 74 is provided through the foot support section 60, a second bore 76 is provided through part 68 of extension 62 and a further bore 78 is provided through upright central section 18. A bolt is then inserted through the bores to meet with a threaded part 80 which may be within bore 78 or which may comprise a nut. The bolt 82 is preferably secured to or within an enlarged head 84 to provide a convenient hand grip.

Thus, to secure the footrest 54 in the folded position 58 the bolt 82 is screwed into the threaded section 80.

To move the footrest to the extended position, the bolt 82 is removed and the footrest unfolded.

The parts 68 and 70 of extension 62 are preferably provided with bores 86 and 88 which, as illustrated in FIG. 3, in the extended position of footrest 54 align with bore 74 of foot support section 60. The bore 88 in part 68 includes a threaded section 90. Thus, when the footrest 54 is in the extended position 56, the bolt 82 can be inserted through bores 74, 86 and 88 and screwed into threaded section 90 to provide additional stability to the footrest 54.

Figure 4:
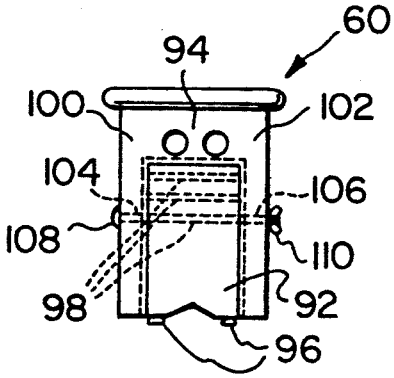
FIG. 4 is a front elevation of a part of a footrest for use in the invention.
Figure 5:
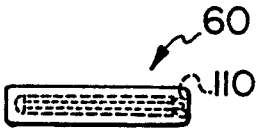
FIG. 5 is a top plan view of a part of a footrest for use in the invention.
Figure 6:
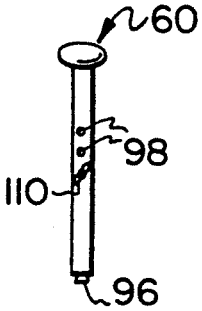
FIG. 6 is a side elevation of a part of a footrest for use with the invention.
Figure 7:
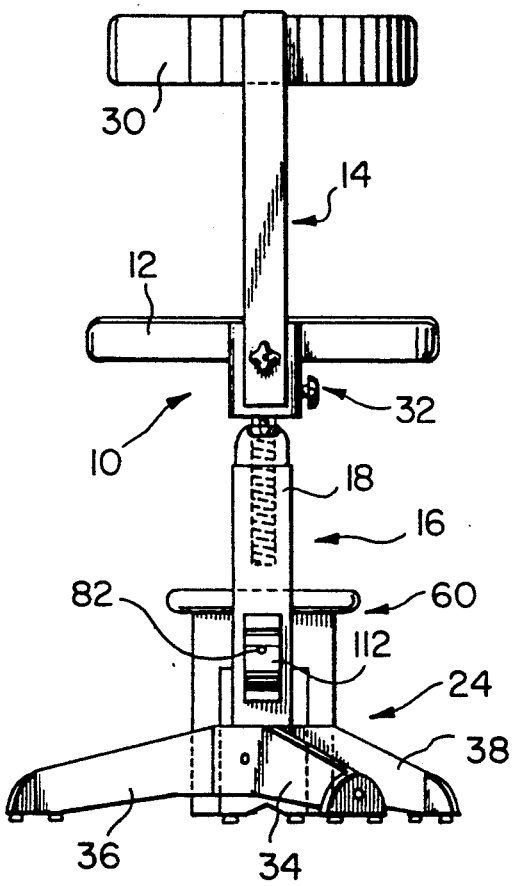
FIG. 7 is a rear elevation of a chair according to the invention.

The foot support section 60 of footrest 54 is preferably vertically adjustable. Thus, as illustrated in FIGS. 4 to 6, the foot support section 60 preferably comprises a lower section 92 and an upper section 94. The lower section 92 is preferably provided with feet 96 which in the extended position 56 of footrest 5 normally rest on the floor or other surface upon which chair 10 is supported.

Upper section 94 is preferably slidable vertically relative to section 92. A tongue and groove arrangement is preferably provided to allow the sliding action.

Lower section 92 is provided with a series of bores 98 and sides 100 and 102 of section 94 are provided with aligned bores 104 and 106. As section 94 is slid up or down along section 92, the bores 104 and 106 become aligned with one of the series of bores 98. A bolt 108 is then inserted through the aligned bores and secured in position by a wing nut 110.

The footrest 54 can thus be vertically adjusted to an appropriate height for the person utilizing chair 10.

In the preferred embodiment the chair 10 is provided with a heel rest 112 which is secured on upright central section 18. In a preferred case the heel rest 112 is secured directly opposite to the footrest 54. Thus, as illustrated in FIG. 2, the threaded section 80 is actually located within a bore 114 provided for the purpose in heel rest 112.

Thus it is apparent that there has been provided in accordance with the invention a musician's chair that fully satisfies the objects, aims and advantages set forth above. While the invention has been described in conjunction specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A musician's chair comprising:

a seat;

a backrest extending upwardly from one side of said seat;

a support for said seat, said support comprising an upright central part to the top and a bottom, and to the top of which said seat is attached and to the bottom of which a stabilizing base section is attached; said base section comprising at least three spaced legs extending outwardly of said bottom of said upright central part, each said leg having toward an outer end thereof a cross member from which depend a pair of feet, one said foot spaced to each side of said leg; and a footrest secured to said base section or said upright central part and selectively moveable between a folded position adjacent said upright central part of said support and an extended position outwardly of said upright central part, and wherein said footrest when in said extended position is selectively adjustable over a range of height adjustments independently of adjustment of the height of said seat.

2. The chair of claim 1, wherein said stabilizing base section comprises at least three spaced legs extending outwardly of said bottom of said upright central part, each said leg having toward an outer end thereof a cross member from which depend a pair of feet, one said foot spaced to each side of said leg.

3. The chair of claim 1, wherein said footrest comprises a foot support section and an extension section,, and wherein said extension section is hingedly connected at first and second ends thereof to respective ones of said foot support section and said upright central part.

4. The chair of claim 3, wherein said extension section comprises two parts which are hingedly connected to each other.

5. The chair of claim 4, including means for securing said footrest in said folded position.

6. The chair of claim 5, wherein said means for securing comprises means securing said foot support section to said upright central section.

7. The chair of claim 1 having a heel support structure secured to said upright central section between said seat and said stabilizing base section.

8. The chair of claim 7, wherein said heel support structure is secured on an opposite side of said upright central section from said footrest.

9. A musician's chair comprising:

a seat;

a backrest secured to and extending upwardly from one side of said seat;

a support for said seat, said support comprising an upright central part having a top and a bottom, and to the top of which said seat is attached and to the bottom of which a stabilizing base section is attached;

a footrest secured to said base section or said upright central part and selectively moveable between a folded position adjacent said upright central part of said support and an extended position outwardly of said upright central part; wherein said footrest when in said extended position is selectively adjustable over a arrange of height adjustments independently of adjustment of the height of said seat; and wherein said footrest comprises a foot support section, and an extension section comprising first and second members which are hingedly connected to each other and said extension section having first and second ends hingedly connected to said foot support section and to said base section or said upright central part respectively; and means for securing said footrest when in said folded position, said means comprising means securing said foot support section to said upright central section.

10. A musician's chair comprising:

a seat;

a backrest secured to and extending upwardly from one side of said seat;

a support for said seat, said support comprising an upright central part having a top and a bottom, and to the top of which said seat is attached and to the bottom of which a stabilizing base section is attached; and a footrest secured to said base section or said upright central part and selectively moveable between a folded position adjacent said upright central part of said support and an extended position outwardly of said upright central part, and wherein said footrest when in said extended position is selectively adjustable over a range of height adjustments independently of adjustment of the height of said seat; and wherein said stabilizing base section comprises at least three spaced legs extending outwardly of said bottom of said upright central part, each said leg having toward an outer end thereof a cross member from which depend a pair of feet, one said foot spaced to each side of said leg.

11. A musician's chair comprising:

a seat;

a backrest secured to and extending upwardly from one side of said seat;

a support for said seat, said support comprising an upright central part having a top and a bottom, and to the top of which said seat is attached and to the bottom of which a stabilizing base section is attached; and a footrest secured to said base section or said upright central part and selectively moveable between a folded position adjacent said upright central part of said support and an extended position outwardly of said upright central part, and wherein said footrest when in said extended position is selectively moveable over a range of height adjustment; and wherein said footrest comprises a foot support section and an extension section, and wherein said extension section is hingedly connected at first and second ends thereof to respective ones of said foot support section and said upright central part; and said foot support section comprises a lower section which, when said footrest in use is in said extended position, is supported on a surface upon which said chair is supported, and an upper section which is slidable and selectively positionable vertically relative to said lower section.

12. The chair of claim 11, wherein said upper section includes a series of bores therethrough, said lower section includes a bore therethrough, and said upper section is positionable by inserting a positioning bolt through one of said series of bores and through said bore in said lower section.

13. The chair of claim 12, wherein said positioning bolt is secured in position by a wing nut.

14. A musician's chair comprising:

a seat;

a backrest secured to and extending upwardly from one side of said seat;

a support for said seat, said support comprising an upright central part having a top and a bottom, and to the top of which said seat is attached and to the bottom of which a stabilizing base section is attached; said stabilizing base section comprising at least three spaced legs extending outwardly of said bottom of said upright central part, each said leg having toward an outer end a cross-member from which depends a pair of feet, one said foot spaced to each side of said leg;

a footrest secured to said base section or said upright center part and selectively moveable between a position adjacent said upright central part of said support and an extended position outwardly of said upright central part; wherein said footrest when in said extended position is selectively moveable over a range of height adjustments; and wherein said footrest comprises a foot support section, and an extension section comprising first and second members which are hingedly connected to each other and said extension section having first and section ends hingedly connected to said foot support section and to said base section or said upright central part respectively; and means for securing said footrest when in said folded position, said means comprising a bolt passing through a bore and said foot support part and received in a threaded bore associated with said upright central section.

15. A musician's chair comprising:

a seat;

a backrest secured to and extending upwardly form one side of said seat;

a support for said seat, said support comprising an upright central part having a top and a bottom, to the top of which said seat is attached to the bottom of which a stabilizing base section is attached; and a footrest secured to said base section or said upright central part and selectively moveable between a folded position adjacent said upright central part of said support and an extended position outwardly of said central part; wherein said footrest comprises a foot support section, and an extension section comprising first and second members which are hingedly connected to each other and said extension section having first and second ends hingedly connected to said foot support section and to said base section or said upright central part respectively; and wherein said foot support section comprises a lower section which, when said footrest is in said extended position, is supported on the surface upon which said chair is supported, and an upper section which is slidable and selectively positionable vertically relative to said lower section.

16. The chair of claim 15, wherein said upper section includes a series of bores therethrough, said lower section includes a bore therethrough, and said upper section is positionable by inserting a positioning bolt through one of said series of bores and through said bore in said lower section.

17. The chair of claim 16, wherein said positioning bolt is secured in position by a wing nut.

18. A musician's chair comprising:

a seat;

a backrest secured to and extending upwardly form one side of said seat;

a support for said seat, said support comprising an upright central part having a top and a bottom, and to the top of which said seat is attached and to the bottom of which a stabilizing base section is attached;

a footrest secured to said base section or said upright center part and selectively moveable between a folded position adjacent said upright central part of said support and an extended position outwardly of said upright central part; wherein said footrest when in said extended position is selectively moveable over a range of height adjustments; and wherein said footrest comprises a foot support section, and an extension section comprising first and second members which are hingedly connected to each other and said extension section having first and second ends hingedly connected to said foot support section and to said base section or said upright central part respectively; and means for securing said footrest when in said folded position, said means comprising a bolt passing through a bore in said foot support part and received in a threaded bore associated with said upright central section.

* * * * *